US009334652B2

(12) United States Patent
Plath et al.

(10) Patent No.: US 9,334,652 B2
(45) Date of Patent: May 10, 2016

(54) PANELING SYSTEM

(75) Inventors: David Plath, Las Vegas, NV (US); Neal Bunce, Lakewood, CO (US)

(73) Assignee: David Plath, Las Vegas, NV (US)

( * ) Notice: Subject to any disclaimer, the term of this patent is extended or adjusted under 35 U.S.C. 154(b) by 163 days.

(21) Appl. No.: 13/105,686

(22) Filed: May 11, 2011

(65) Prior Publication Data

US 2011/0283649 A1 Nov. 24, 2011

Related U.S. Application Data

(60) Provisional application No. 61/346,546, filed on May 20, 2010.

(51) Int. Cl.

| | |
|---|---|
| ***E04D 3/365*** | (2006.01) |
| ***E04D 1/18*** | (2006.01) |
| ***E04D 1/26*** | (2006.01) |
| ***E04D 3/30*** | (2006.01) |
| ***E04D 13/10*** | (2006.01) |
| ***E04F 13/08*** | (2006.01) |
| ***E04F 13/12*** | (2006.01) |
| *E04D 1/36* | (2006.01) |

(52) U.S. Cl.

CPC *E04D 3/365* (2013.01); *E04D 1/18* (2013.01); *E04D 1/265* (2013.01); *E04D 3/30* (2013.01); *E04D 13/10* (2013.01); *E04F 13/0864* (2013.01); *E04F 13/12* (2013.01); *E04D 1/365* (2013.01)

(58) Field of Classification Search

CPC ..... E04F 13/0864; E04F 13/0803; E04F 13/0842; E04F 13/12; E04D 3/362; E04D 3/365; E04D 13/10; E04D 1/265; E04D 3/30; E04D 1/18; E04D 1/365; E04D 2001/3432; E04D 2001/3458

USPC ..... 52/506.01, 506.05, 509, 510, 512, 520, 52/543, 545, 547, 549, 550, 552, 556

See application file for complete search history.

(56) References Cited

U.S. PATENT DOCUMENTS

| | | | | | |
|---|---|---|---|---|---|
| 1,463,482 | A | * | 7/1923 | Mountford | E04D 1/34 52/547 |
| 1,642,088 | A | * | 9/1927 | Scarff | E04D 5/142 52/547 |
| 1,968,451 | A | * | 7/1934 | Hering | E04D 1/34 52/466 |
| 2,522,067 | A | * | 9/1950 | Sperry | E04D 3/366 52/409 |
| 2,685,852 | A | * | 8/1954 | Godel | E04D 1/06 52/16 |
| 3,110,130 | A | * | 11/1963 | Trachtenberg | 52/545 |
| 3,195,701 | A | * | 7/1965 | Brazelton | 52/461 |
| 3,380,214 | A | * | 4/1968 | Stevens | 52/478 |
| 4,163,445 | A | * | 8/1979 | Stanger | E04D 3/362 126/620 |
| 4,189,881 | A | * | 2/1980 | Hawley | E04D 3/366 136/244 |

(Continued)

FOREIGN PATENT DOCUMENTS

| | | | | |
|---|---|---|---|---|
| DE | 3329812 A1 | * | 2/1985 | E04F 13/08 |

*Primary Examiner* — Robert Canfield
*Assistant Examiner* — Matthew Gitlin
(74) *Attorney, Agent, or Firm* — The Ollila Law Group LLC

(57) ABSTRACT

A paneling system (100) is provided according to an embodiment of the invention. The paneling system (100) comprises a panel (101) and one or more fastening elements (102). The one or more fastening elements (102) are coupled to the panel (101). The one or more fastening elements (102) extend from a first edge (110) of the panel (101) to a second edge (111) of the panel (101).

18 Claims, 6 Drawing Sheets

(56) References Cited

U.S. PATENT DOCUMENTS 4,288,958 A * 9/1981 Chalmers et al. ..... 52/478
4,356,673 A * 11/1982 Gailey ..... 52/127.1
4,382,354 A * 5/1983 Gailey et al. ..... 52/521
4,646,501 A * 3/1987 Champagne ..... E04F 13/0864 52/520
4,655,020 A * 4/1987 Ginn, Jr. ..... E04D 3/38 52/521
D316,810 S * 5/1991 Blackford ..... D8/382
5,022,207 A * 6/1991 Hartnett ..... E04D 13/152 52/478
5,134,825 A 8/1992 Berridge
D339,875 S * 9/1993 Schutz et al. ..... D25/139
D341,667 S * 11/1993 Schultz et al. ..... D25/139
5,355,649 A * 10/1994 Berridge ..... 52/520
5,398,476 A * 3/1995 Knight ..... E04D 13/00 126/622
5,613,337 A 3/1997 Plath et al.
5,642,596 A * 7/1997 Waddington ..... 52/546
5,685,117 A * 11/1997 Nicholson ..... 52/520
5,956,913 A 9/1999 Nicholson
6,052,961 A * 4/2000 Gibbs ..... E04D 1/16 52/518
6,155,006 A * 12/2000 Mimura ..... E04D 1/365 136/244
6,182,403 B1 * 2/2001 Mimura ..... E04D 3/362 126/621
6,415,581 B1 * 7/2002 Shipman et al. ..... 52/798.1
8,381,472 B1 * 2/2013 Fleenor ..... 52/459
8,715,808 B2 * 5/2014 Roming ..... B64C 1/064 244/131
9,010,038 B1 * 4/2015 Stearns ..... E04D 13/00 52/173.1

* cited by examiner

PANELING SYSTEM

RELATED APPLICATIONS

This application claims the benefit of U.S. provisional application No. 61/346,546 filed on May 20, 2010 entitled "Paneling System" which is hereby incorporated by reference into this application.

TECHNICAL FIELD

The present invention is related to a paneling system, and more particularly, to a paneling system including a panel that is secured to a surface with one or more fastening elements that extend across a height of the panel.

BACKGROUND OF THE INVENTION

In response to increasing concerns associated with the disposal of traditional asphalt roofing shingles as well as other roof products that cannot be recycled, numerous metal roofing and siding systems have been developed. Some metal roofing systems have employed standardized sized shingles that interconnect one another in an attempt to form a moisture proof barrier. Typically, the edges of each shingle are overturned in a manner that allows a specified side of the shingle to engage adjoining shingles. Although this system provides adequate results in mild weather conditions, the joint between the shingles often leaks in severe weather.

In an attempt to overcome this problem, a vertical seam panel system was developed where metal panels are provided that extend from the eaves of the building to the ridge. A plurality of panels are placed side-by-side along the length of the structure. Although this system removed the horizontal seams, the vertical seams were still subject to moisture penetration. Additionally, transportation of the relatively large panels can be costly and in some circumstances prohibitive.

Other prior art systems have been developed using continuous length panels rolled from coils of metal. The advantage of such a system is that the coil can be cut so a single panel can extend the entire length of the building. A plurality of panels can be attached to the roof starting at the eaves and working towards the ridge. As the panels are connected together, horizontal seams are formed that extend along the length of the building. While continuous length panels have the benefit of a reduced number of seams, one problem is the ability to properly secure the long panels to the underlying structure. Additionally, it has been difficult to retain the rigidity of the panels often resulting in buckling of the panels.

Prior art attempts to secure the panels to the underlying structure include clips that connect to the upper end of the panel and are then screwed to the roofing substrate. Typically, the clips are designed to be as short as possible in order to avoid being visible after the subsequent panel is installed. The drawback to such a system is that although the panels may be cut to the length of the building, the panels lack sufficient strength over a predetermined length. Therefore, the panels are subject to buckling, referred to as oil canning in the art, and damage in the event of severe weather. This is evidenced in U.S. Pat. No. 5,355,649, which discloses a horizontal roof panel system that includes an expansion joint that can be used to connect two adjoining panels side by side. The problem with such a system is that a vertical joint is created, which is generally not desired. Therefore, the expansion joint creates an additional location susceptible to leaking.

The present invention overcomes this and other problems and an advance in the art is achieved by providing a substantially continuous panel that reduces the number of seams thereby reducing the potential for moisture penetration. The present invention also provides a structurally strong and aesthetically pleasing paneling system. The present invention allows for a customized aesthetic appearance.

SUMMARY OF THE INVENTION

A paneling system is provided according to an embodiment of the invention. The paneling system comprises a panel and one or more fastening elements. The fastening elements are coupled to the panel. The fastening elements extend from a first edge of the panel to a second edge of the panel.

A fastening element for a paneling system is provided according to an embodiment of the invention. The fastening element includes a coupling tab formed at a first end of the fastening element. The coupling tab is adapted to couple to a first edge of a panel. The fastening element also includes an engagement lip. The engagement lip is formed at a second end of the fastening element. The engagement lip is adapted to couple to a second edge of the panel.

A method for paneling a surface of a building is provided according to an embodiment of the invention. The method comprises positioning one or more panels on the surface of the building. One or more fastening elements are coupled to a panel of the one or more panels. The fastening elements extend from a first edge of the panel to a second edge of the panel. The fastening elements are then coupled to the surface of the building.

Aspects

Preferably, the one or more fastening elements comprise a coupling tab.

Preferably, the coupling tab is provided at an angle ($\theta$) with respect to a longitudinal axis of the fastening element.

Preferably, the paneling further comprises an aperture formed in the coupling tab and adapted to receive a fastening member.

Preferably, the paneling system further comprises an engagement lip formed on a fastening element of the one or more fastening elements.

Preferably, the one or more fastening elements further comprise a rib.

Preferably, the panel comprises one or more lips.

Preferably, the one or more fastening elements are coupled to the one or more lips.

Preferably, the one or more fastening elements include one or more stops.

Preferably, the fastening element further comprises an aperture formed in the coupling tab.

Preferably, the fastening element further comprises a rib.

Preferably, the fastening element further comprises a seal formed in at least one of the coupling tab and the engagement lip.

Preferably, the fastening element further comprises a stop.

Preferably, the method further comprises the step of extending the one or more panels substantially entirely across a length of the surface of the building.

Preferably, the method further comprises the step of coupling a first lip formed on a first panel to a second lip formed on a second adjoining panel to form a substantially water tight seal.

Preferably, the method further comprises the step of coupling a sealing member to at least one of the first lip or the second lip.

Preferably, the step of positioning the one or more panels on the surface of the building comprises positioning adjoining panels such that a horizontal seam is formed.

Preferably, the step of coupling one or more fastening elements to the panel comprises positioning the one or more fastening elements at substantially regular intervals along a length of the panel.

Preferably, the step of coupling one or more fastening elements to the panel comprises coupling the one or more fastening elements to a first lip and a second lip of the panel.

Preferably, the step of coupling one or more fastening elements to the panel comprises coupling the one or more fastening elements to a top surface of the panel.

Preferably, the method further comprises the step of coupling one or more stops to the one or more fastening elements.

DETAILED DESCRIPTION OF THE INVENTION

FIGS. 1-7 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
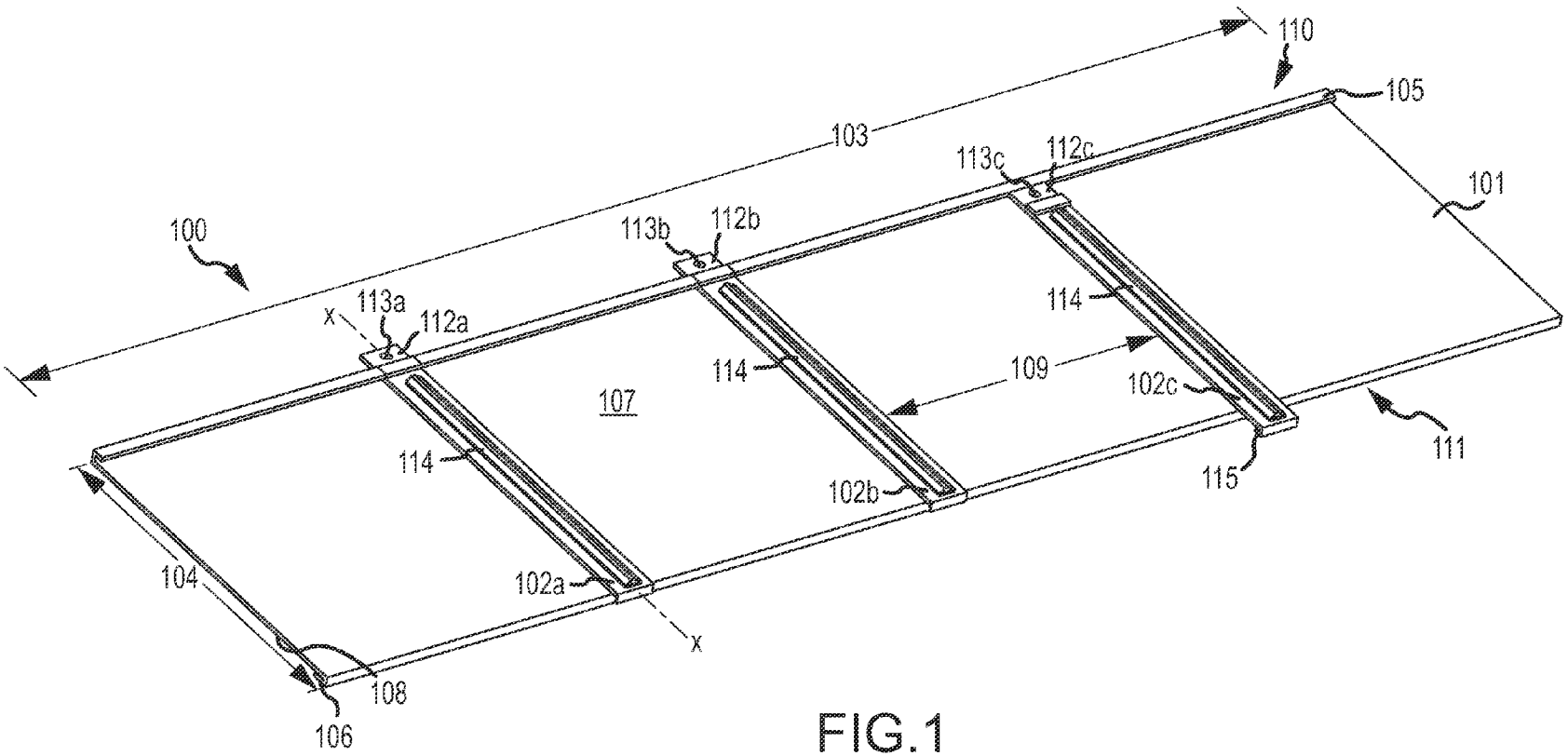
FIG. 1 shows a panel system according to an embodiment of the invention.
Figure 3:
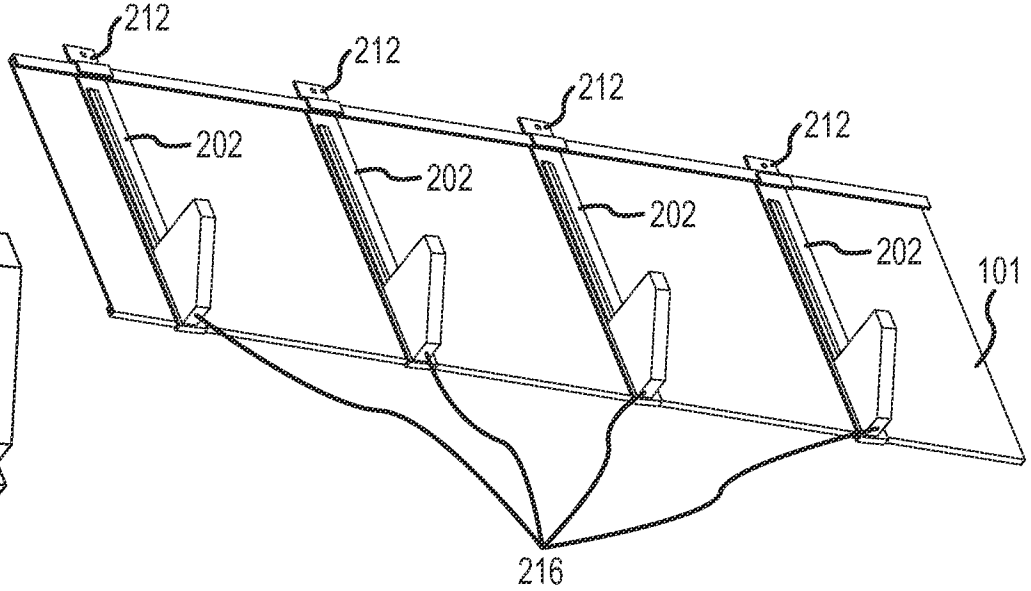
FIG. 3 shows a panel system according to another embodiment of the invention.

FIG. 1 shows a paneling system 100 according to an embodiment of the invention. Although the description that follows often refers to a roof or a roofing substrate, it should be appreciated that the paneling system 100 may likewise be used as siding for a building or any other location where a paneling system may be desired. Therefore, the present invention should not be limited to applications to a building's roof.

The paneling system 100 comprises a panel 101 and one or more fastening elements 102. The panel 101 may comprise any desired metallic or synthetic material. Although, Kynar 500® painted Galvalume® and aluminum has been widely accepted in the art due to its durability, those skilled in the art will readily recognize alternative materials that may be used. The panel 101 may be painted to any desired color. In the embodiment shown in FIG. 1, three fastening elements 102*a*, 102*b*, 102*c* are shown. The fastening elements 102*a* and 102*b* are shown fully engaged with the panel 101 while the third fastening element 102*c* is shown prior to full engagement. The fastening elements 102 may comprise the same color or a different color as the panel 101. In some embodiments, the fastening elements 102 may be colored as an accent color chosen depending on the owner's request.

The panel 101 comprises a length 103 and a height 104. Although not shown to scale, it should be appreciated that the panel 101 also comprises a thickness that is based primarily on the thickness of the metal coil or other material used to form the panel 101. According to an embodiment of the invention, the length 103 can be customized to extend substantially the entire length of the building (not shown). However, it should be appreciated that the panel 101 does not have to extend the entire length of the building. In some embodiments, multiple panels may be used to form a single row. This may be required in extremely long surfaces where thermal expansion makes extending a single panel the entire length prohibitive. In other embodiments, the particular material used to form the panel 101 may limit the desired length for a single panel to a predetermined length, for example sixteen feet. Further, the use of multiple panels to form a single row may be required in embodiments where the panels are formed away from the job site at predetermined lengths, for example ten feet. In this embodiment, the panels may be coupled together side by side according to known methods. Various methods are known from U.S. Pat. No. 5,613,337; U.S. Pat. No. 5,355,649; and U.S. Pat. No. 5,956,913, for example. The panel 101 may be formed from a metal coil using a metal roll former or similar device to form the panel 101 into a desired length. Advantageously, the panel 101 can be formed on the job site eliminating the need to custom order each panel 101 and then deliver pre-cut panels. This on site forming can reduce the cost of shipping as well as reduce the time required to finish the job in the event that a panel is not initially formed to the appropriate size.

In some embodiments, it may be desirable to provide a design on the panel 101. Therefore, the panel 101 may be embossed using an embossing roller prior to forming and cutting the panel 101. For example, a metal coil or a flat sheet may run through the embossing roller prior to being formed into the panel 101 and cut to the desired length. Embossing a design on the panel 101 can provide a number of advantages. One advantage is that the design can provide additional grip to the panel 101. This can reduce danger of walking on the panel 101 during installation, for example, when the paneling system 100 is installed on a roof. The embossed design may comprise a diamond or some other irregular shape. Another advantage is that the embossed design can be chosen to reflect sunlight. One of the major concerns with metal roofing is the sun glare experienced as the sun is reflected off from the metal. The embossed design can aid in dispersing the reflected light so as to create the appearance of a duller finish. There are numerous additional advantages in embossing a design onto the panel and the particular examples provided should not limit the scope of the invention.

According to an embodiment of the invention, the height 104 can be chosen depending on the particular application. For example, a standard height for metal coil may be approximately 12 inches. However, if other heights are desired, other metal coils, flat metal sheets, or panels 101 formed from other suitable materials may be chosen. Those skilled in the art will readily recognize other suitable materials that may be used to form the panel 101 based on the particular application.

According to an embodiment of the invention, the panel 101 also includes lips 105 and 106. The lip 105 is shown at the top edge 110 of the panel 101 while the lip 106 is shown at the bottom edge 111 of the panel 101. As can be seen, the lips 105, 106 are extending in opposite directions. The lip 105 folds over the top surface 107 of the panel 101 and extends towards a bottom edge 111, while the lip 106 folds beneath the panel 101, and faces the bottom surface 108 extending towards the top edge 110 of the panel 101. The lips 105, 106 of adjoining panels may engage one another to couple adjoining panels 101 together. In this manner, adjoining panels 101 can be coupled to one another. Additionally, the fastening elements 102 can engage the lips 105, 106 to retain the panels 101 as described in more detail below.

As shown in FIG. 1, the fastening elements 102 are coupled to the panel 101 at substantially regular intervals with a spacing 109 on center of the fastening element 102. The particular spacing may be chosen based on a number of factors including, but not limited to, the length 103 of the panel 101, the height 104 of the panel 101, the material chosen for the panel 101 and the fastening elements 102, the length of the fastening elements 102, the desired aesthetic design, the expected weather conditions where the panel system 100 is installed, etc. According to one embodiment, a standard spacing between fastening elements 102 may be between approximately nine inches and approximately twenty-four inches on center. It should be appreciated however, that this may be adjusted as needed or desired. For example, the spacing may change from one row to the next in order to create a desired design using the fastening elements 102. In some embodiments, the spacing 109 may be marked on the panel 101 in order to ensure proper and even spacing during installation.

According to an embodiment of the invention, the fastening elements 102 comprise a longitudinal axis X-X that extends substantially the entire height 104 of the panel 101. The fastening elements 102 can engage the lips 105, 106 at the top 110 and bottom 111 edges of the panel 101. The fastening elements 102 may also rest on the top surface 107 of the panel 101. According to an embodiment of the invention, the fastening elements 102 can include an engagement lip 115. The engagement lip 115 can be provided to engage the lip 106 formed on the panel 101. The engagement lip 115 may be sized and shaped to wrap around the lip 106 of the panel 101, for example. The engagement lip 115 can assist in securing the fastening element 102 to the panel 101. Furthermore, the fastening element 102 can include a coupling tab 112. The coupling tab 112 can engage the lip 105 formed at the top edge 110 of the panel 101. The coupling tab 112 therefore, can be provided to assist in coupling the fastening element 102 to the panel 101. The engagement of the lip 115 and coupling tab 112 is shown in greater detail below.

Because the fastening elements 102 extend substantially the entire height 104 of the panel 101 rather than being located only at the top as in the prior art, the fastening elements 102 can also strengthen the panel 101. This not only allows the paneling system 100 to be installed in severe weather climates, but also allows a single panel 101 to extend substantially the entire length of the building, if desired. With the fastening elements 102 extending across the height of the panel 101, an expansion joint as described in the prior art is not needed. Thus, the vertical seams of the prior art can be substantially reduced, or eliminated. Therefore, the panel system 100 of the present invention provides an improvement over the prior art.

The fastening elements 102 may also be used to couple the panel 101 to the roofing substrate (not shown) or other underlying surface. As shown in FIG. 1, the coupling tabs 112 extend beyond the top edge 110 of the panel 101 when the fastening element 102 is fully engaged. It should be appreciated that in other embodiments, the fastening elements 102 may not be used to couple the panel 101 to the roofing substrate, but rather may be provided for aesthetic enhancement and/or for increasing the rigidity of the panel 101. Therefore, although the embodiments shown include the coupling tab 112 extending beyond the top edge 110 of the panel 101, in some embodiments, the coupling tab 112 is substantially even with the top edge 110 or may not even reach the top edge 110. The coupling tabs 112 may include apertures 113 as shown in FIG. 1. The apertures 113 may be provided to accept a fastening member (See FIG. 4), such as a nail or screw, for example. With the fastening element 102 being coupled to the panel 101, the fastening element 102 may then be coupled to the underlying substrate to retain the fastening element 102 as well as the panel 101 in position. The fastening elements 102 may be coupled to the underlying surface in any number of ways including, but not limited to, screws, nails, adhesives, bonding, etc. The particular method used to secure the fastening elements 102 to the underlying surface should not limit the scope of the present invention, as there are numerous suitable methods. As can be appreciated, the fastening elements 102 therefore serve multiple functions. Not only do the fastening elements 102 strengthen the panel 101 because they extend substantially entirely across the height 104 of the panel 101, but they also secure the panel 101 to the roof or other surface.

According to an embodiment of the invention, the fastening elements 102 can also provide aesthetic enhancement to the panel system 100. Unlike prior art fasteners that are hidden from view, the fastening elements 102 of the present invention are visible. Therefore, the fastening elements 102 may take any number of shapes, colors, and materials, as desired. As shown in FIG. 1, the fastening element 102 can include a rib 114. The rib 114 is substantially symmetrical in shape and extends from the fastening element 102. However, the rib 114 does not have to be symmetrical in shape. Furthermore, the rib 114 may not be continuous along the length of the fastening element 102. For example, the rib 114 may be in the form of a plurality of buttons, projections, designs, etc. In addition to the aesthetic appeal of the rib 114, the rib 114 may also increase the stiffening potential of the fastening element 102 by increasing the rigidity of the fastening element 102. According to an embodiment, the rib 114 comprises an integral piece of the fastening element 102. According to another embodiment, the fastening element 102 may include an aperture or slot (not shown) that can be sized and shaped to receive a rib 114, thereby allowing for interchangeable ribs, for example.

Figure 2:
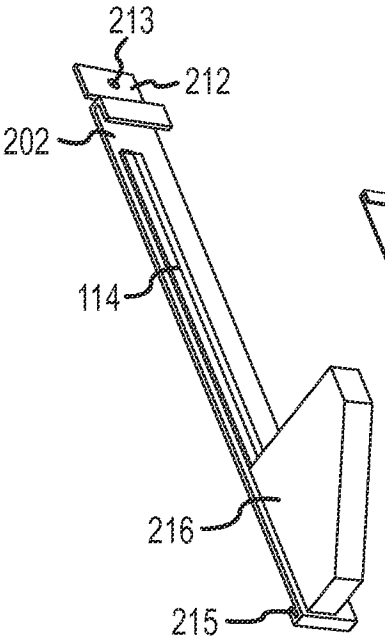
FIG. 2 shows a fastening element according to an embodiment of the invention.

FIG. 2 shows a fastening element 202 according to an embodiment of the invention. In addition to the features shown in FIG. 1, the fastening element 202 additionally includes a stop 216. The stop 216 may be coupled to the fastening element 202 anywhere along its length; however, in FIGS. 2 & 3 the stop 216 is shown near the bottom of the fastening element 202. The stop 216 may be provided in areas where there is a substantial amount of snowfall. The stop 216 may prevent or slow snow accumulated on a building's roof from sliding off the roof and causing damage to people or property. This is a concern, especially with metal roofs, as snow will build up on the roof and then slide off in an avalanche type fall as the snow begins to melt. With the stops 216 in place, the snow can be removed from the roof in a safe and controlled manner. According to an embodiment of the invention, the stops 216 may be formed as an integral part of the fastening element 202. According to an alternative embodiment, the stop 216 can be coupled directly to the panel 101 rather than to the fastening element 102.

While the fastening elements 102 and 202 are shown relatively narrow and occupy a small width of the panel 101, it should be appreciated that in other embodiments, the fastening element 102 may take the shape of a tile and comprise a much larger width, thereby covering a larger portion of the panel 101. Therefore, the particular width shown should in no way limit the scope of the present invention.

Figure 4:
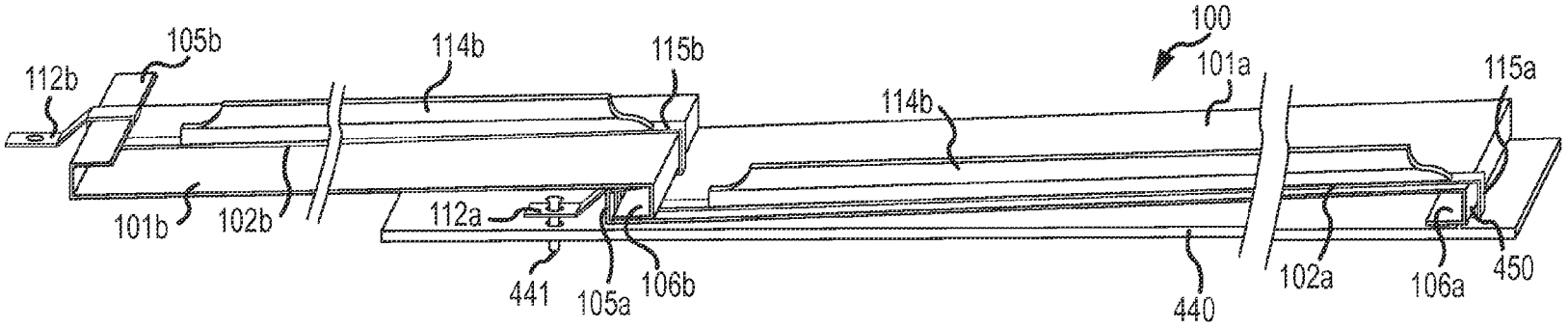
FIG. 4 shows a side view of the panel system according to an embodiment of the invention.

FIG. 4 shows a side view of the panel system 100 according to an embodiment of the invention. As shown, two panels 101*a*, 101*b* are coupled together. The panel 101*b* on the left as shown is installed after the panel 101*a* on the right, i.e., the panel 101*a* would be closer to the roof's eave, while the panel 101*b* would be closer to the roof's ridge. The panel 101*b* does not yet have the fastening element 102 coupled to the underlying substrate 440. With the two panels coupled together, a substantially water tight seal is formed.

To couple the panels as shown in FIG. 4, the panel 101*a* would be placed into position. The panel 101 can be sized such that the length 103 of the panel 101 is approximately the same as the length of the underlying substrate 440 being covered. Alternatively, multiple panels may be used to extend the length of the surface being covered with the panels being coupled in a suitable manner. According to an embodiment of the invention, the panel 101 is positioned such that the seam formed between adjoining panels 101 is substantially parallel to the ground, i.e., the seam comprises a horizontal seam as is generally understood in the art. The sizing can be accomplished on site using a metal roll former or similar device that can accurately cut the panel 101 into the desired length. In this way, a single panel 101 extends across the length of the surface being covered without the need for expansion joints, as in the prior art. Alternatively, the panels 101 may be sized shorter than the entire length of the surface. In this case, multiple panels 101 can be used to form a single row. If a lower panel 101 is already installed, the lip 106*a* of panel 101*a* shown on the right would engage the lip 105 of the preceding panel 101. If the panel 101*a* is the first panel installed, the panel 101*a* may engage the roof's eave or another component shaped to receive the lip 106*a*, which does not comprise a component of the present invention and thus is not shown in order to simplify the drawing. However, as horizontal paneling systems are known in the art, those skilled in the art could readily understand how to attach the first panel 101*a*.

Once the panel 101*a* is in position, the fastening elements 102 would then be coupled to the top surface 107 of the panel 101*a*. The fastening elements 102 can be coupled to the lip 106 using the engagement lip 115 as well as to the lip 105 using the coupling tab 112. As can be appreciated, the coupling tab 112 may be bent multiple times to correspond to the shape of the lip 105 in order to rap around the lip 105. This is shown in greater detail in FIG. 2. This coupling helps to secure the fastening element 102 to the panel 101. Once the fastening element 102 is coupled to the panel 101, the fastening element 102, and more particularly, the coupling tab 112 can be secured to the underlying substrate 440. A fastening member 441, such as a screw or a nail, for example, may be used to secure the coupling tab 112 to the underlying substrate 440. The underlying substrate 440 may comprise a roofing substrate, a siding substrate, or any other suitable surface that is desired to be covered. The particular underlying substrate will depend on where the paneling system 100 is installed. After the fastening elements 102 have been properly secured to the underlying substrate, the next panel 101 can be installed in a similar manner. As can be seen, the lip 106*b* of the panel 101*b* has engaged the lip 105*a* of the panel 101*a*. As can be seen, the lip 106 has also engaged the top portion of the fastening element 102*a*.

In some embodiments, the simple overlapping of the lips 105, 106 may provide a sufficient waterproof sealing. However, as can be appreciated, in other embodiments, a separate sealing member, such as foam, rubber, etc., may be positioned between the lips 105, 106 in order to increase the sealing capabilities of the paneling system 100. As shown in FIG. 4, in some situations, it may be difficult to apply the appropriate tension in the fastening elements 102 in order to provide the tight coupling between the fastening elements 102 and the panel 101 that is required to form a watertight seal. For example, in the embodiment shown in FIG. 4, the fastening element 102*a* leaves a small gap 450 between the engagement lip 115*a* of the fastening element 102*a* and the lip 106*a* of the panel 101*a*. While the size of this gap 450 is shown exaggerated for illustration purposes, the present inventors have discovered that this gap 450 can be reduced or eliminated.

Figures 5A, 5B:
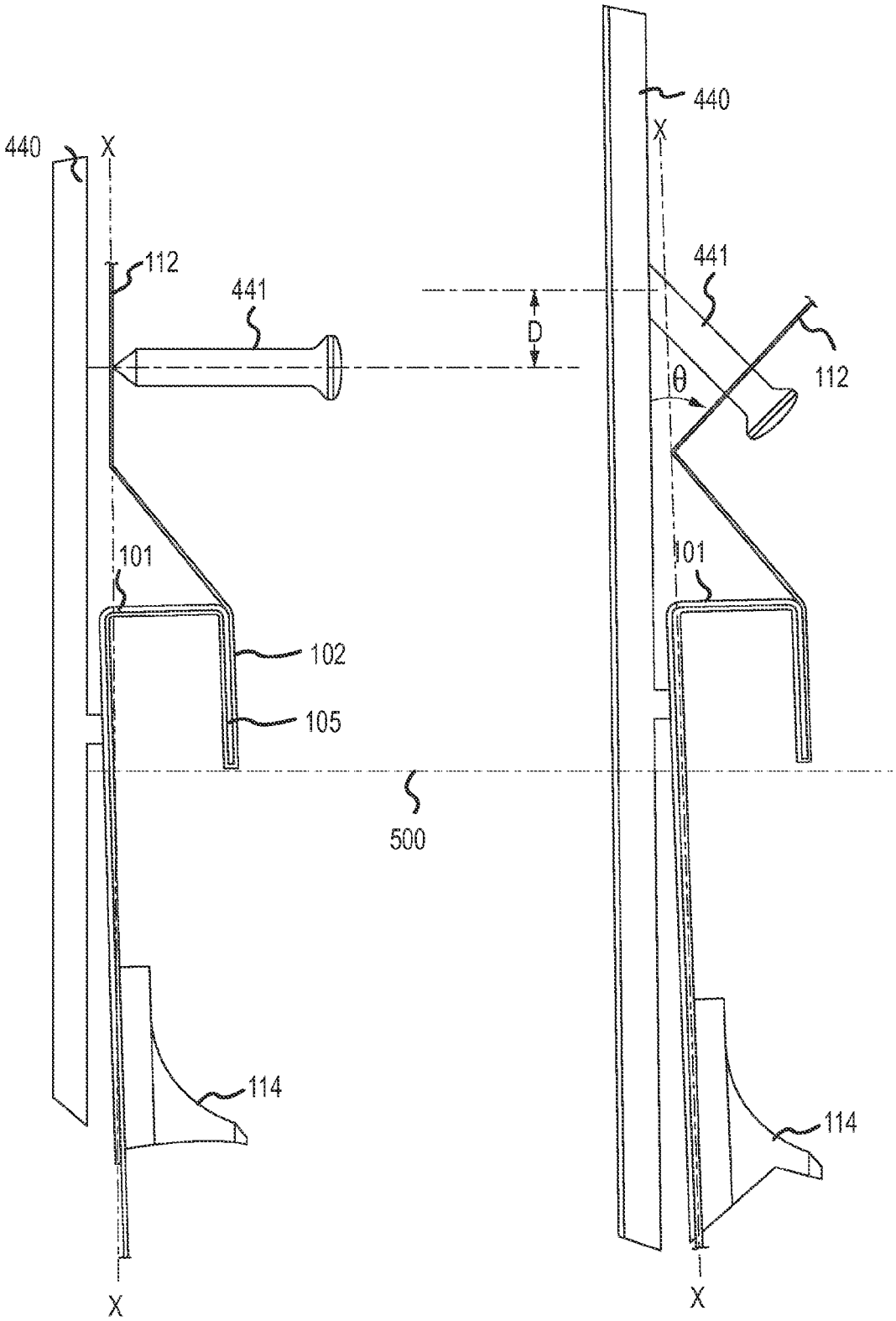
FIG. 5A shows a coupling tab according to an embodiment of the invention.
FIG. 5B shows a coupling tab according to another embodiment of the invention.

FIGS. 5A and 5B show side-by-side views of the coupling tab 112 of two different fastening elements 102 prior to the fastening member 441 being fully inserted into the underlying substrate 440. According to the embodiment shown in FIG. 5A, the coupling tab 112 is substantially parallel to the underlying substrate 440 as well as the longitudinal axis X-X. This parallel orientation results in the fastening member 441 being installed substantially perpendicular to the underlying substrate 440 and substantially no movement of the fastening element 102 occurs as the fastening member 441 is installed.

In contrast, the fastening element 102 shown in FIG. 5B includes a tab 112 that is angled away from the underlying substrate 440, and thus, the longitudinal axis X-X, by an angle θ. For example, the coupling tab 112 may be angled between approximately 0-55° away from the longitudinal axis X-X. More preferably, the angle θ is between 35 and 50°. It should be appreciated that the particular angle will vary based on the particular materials used for the panels 101 and the fastening elements 102 as well as the particular size of the components. Assuming the panels 101 are positioned equally with respect to the reference line 500, and the coupling tab 112 is angled away from the underlying substrate, the fastening member 441 contacts the underlying substrate 440 above the point that the fastening member 441 on the left contacts the underlying substrate 440 by a distance, D. In experimental testing, an angle of approximately 45° resulted in the fastening member 441 engaging the substrate 440 approximately 0.46 inches higher. This offset, D, results in the fastening element 102 being drawn upwards as shown in FIGS. 5A & 5B (to the left as shown in FIG. 4) resulting in a tighter fitting between the fastening element 102 and the panels 101. As can be appreciated, as the fastening member 441 is installed, the coupling tab 112 flattens out and contacts the underlying substrate 440.

The upward movement of the fastening element 102 results in increased tension in the fastening element 102. This increased tension reduces movement of the fastening elements 102 along the length 103 of the panels 101 while being installed as well as during severe weather. Consequently, the fastening element 102 with the angled coupling tab 112 provides a stronger and more secure paneling system 100.

Figure 6:
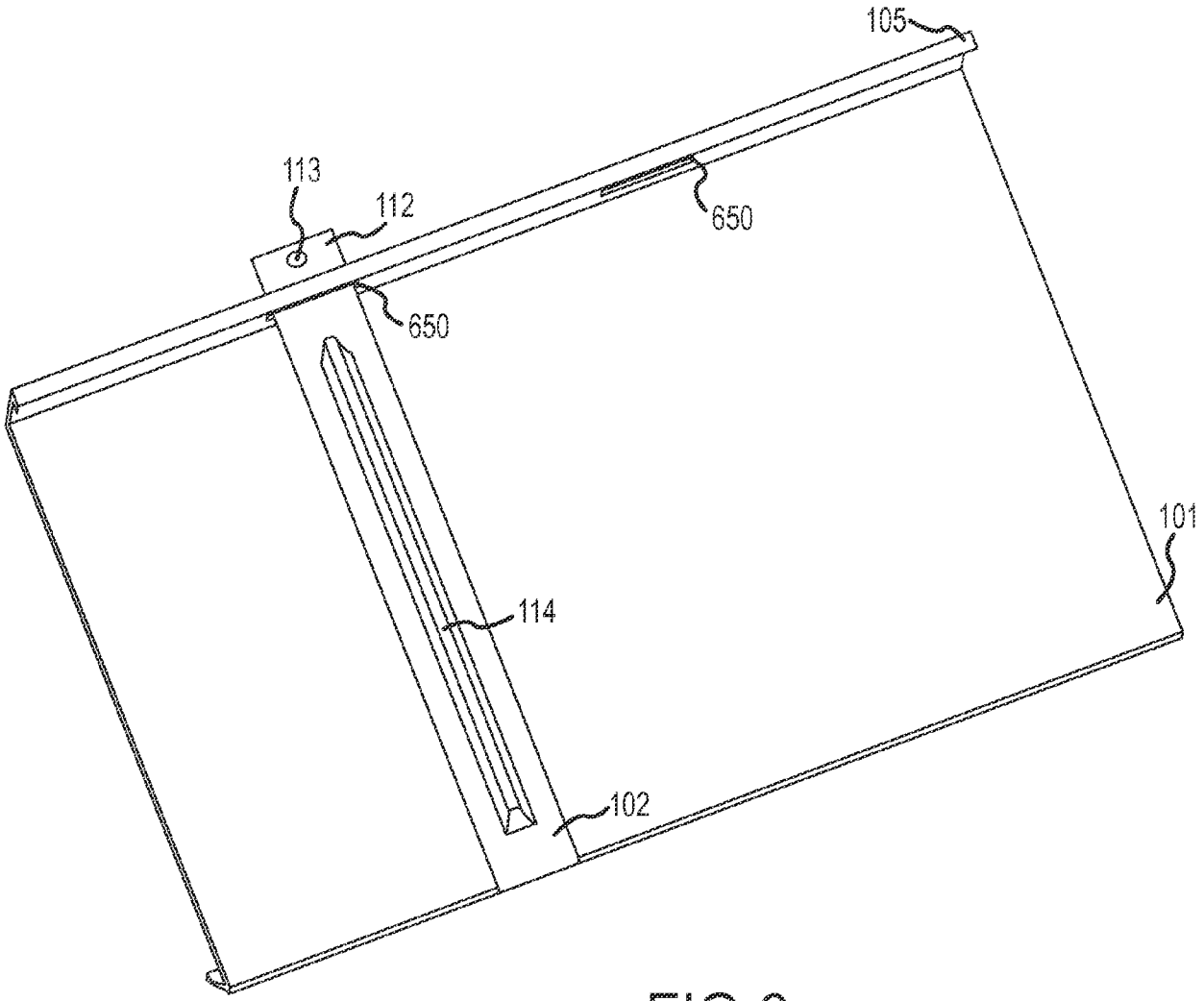
FIG. 6 shows a panel system according to another embodiment of the invention.

The embodiments described above include the coupling tab 112 coupling over the lip 105. It should be appreciated however, that in other embodiments, the lip 105 may comprise an aperture 650. The coupling tab 112 can then extend through the aperture 650. Such a configuration is shown in FIG. 6. Although not shown to scale, FIG. 6 shows the panel 101 include a plurality of apertures 650. The apertures 650 are formed in the fold 105 and sized and located to receive a portion of the fastening elements 102. More particularly, the apertures 650 are sized and located to receive the coupling tab 112 of the fastening elements 102. Therefore, in the embodiments shown in FIG. 6, the coupling tab 112 extends through the aperture 650 formed in the lip 105. Thereafter, the coupling tab 112 can be coupled to the underlying substrate as described above. The aperture 650, the fastening element 102, or both may include a sealing member to form a substantially fluid-tight seal between the aperture 650 and the fastening element 102.

Figure 7:
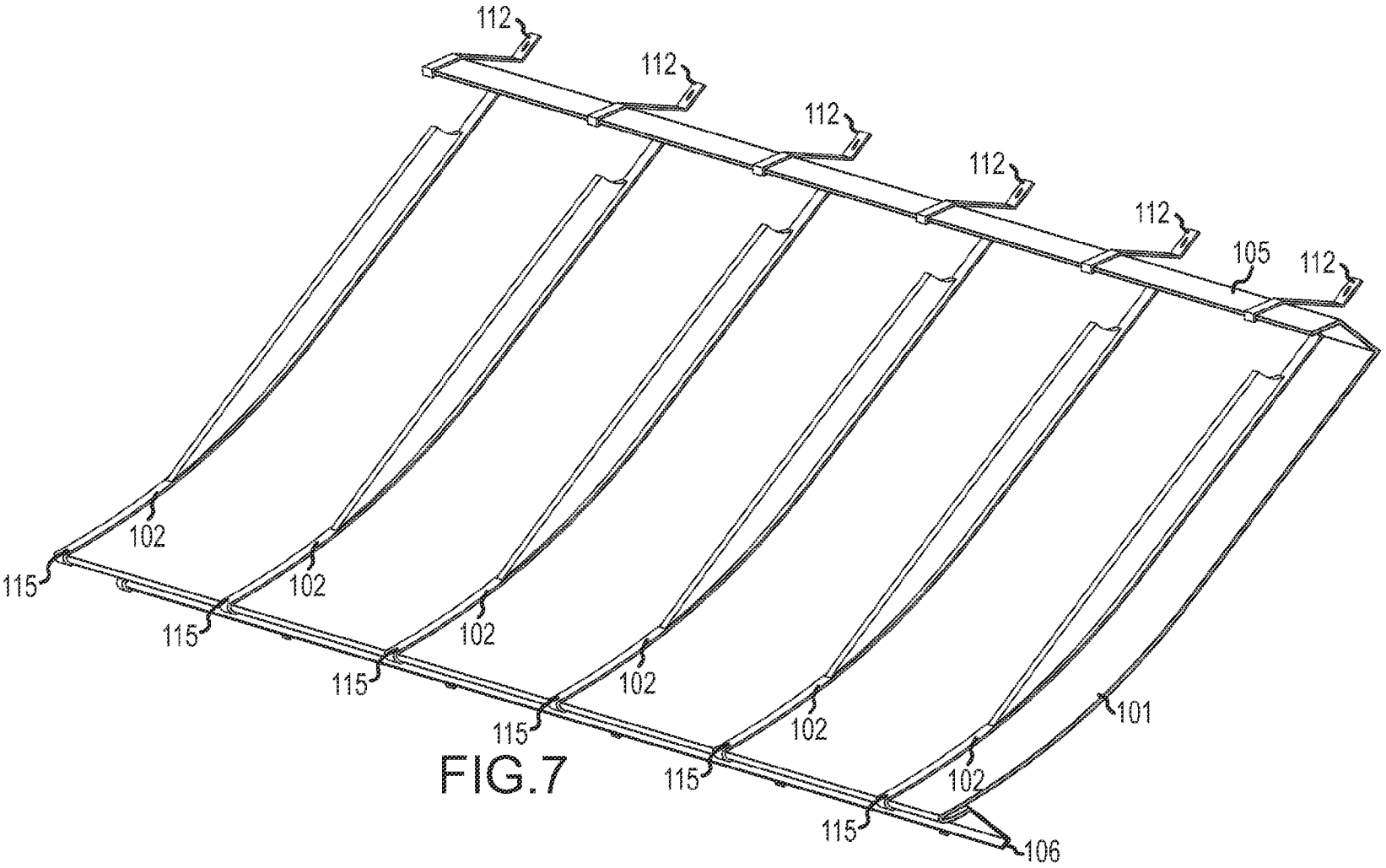
FIG. 7 shows a panel system according to yet another embodiment of the invention.

FIG. 7 shows the paneling system 100 according to another embodiment of the invention. In the embodiment shown in FIG. 7, the fastening elements 102 are curved rather than straight. The curvature that is formed in the fastening elements 102 proximate the engagement lip 115 causes a substantially matching curvature to be formed in the panels 101 once the fastening elements 102 are engaged. The curvature in the fastening elements 102 can provide an alternative aesthetic look to the paneling system 100.

According to an embodiment, because the curvature in the fastening elements 102 raise the panels 101 proximate the lip 106, a longer fastening element 102 and wider panel 101 is required in order to maintain contact with the underlying substrate.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other paneling systems, and not just to the embodiments described above and shown in the accompanying figures. Accordingly, the scope of the invention should be determined from the following claims.

We claim:

1. A paneling system (100), comprising:

a panel (101) with a top surface (107), a lip (105) at a first edge (110) of the panel (101), and a lip (106) at a second edge (111) of the panel (101); and two or more fastening elements (102) coupled to the top surface (107) of the panel (101) and engaged with the lips (105, 106), the two or more fastening elements (102):

extending from the first edge (110) of the panel (101) to the second edge (111) of the panel (101) and resting on the top surface (107) of the panel (101); and comprising a rib (114) that is visible and extending along substantially an entire length of the two or more fastening elements (102) from the first edge (110) to the second edge (111) such that the top surface (107) is substantially visible when the two or more fastening elements (102) are coupled to the top surface (107) of the panel (101).

2. The paneling system (100) of claim 1, wherein the two or more fastening elements (102) comprises a coupling tab (112).

3. The paneling system (100) of claim 2, wherein the coupling tab (112) is provided at an angle (θ) with respect to a longitudinal axis X-X of the fastening element (102).

4. The paneling system (100) of claim 2, further comprising an aperture (113) formed in the coupling tab (112) and adapted to receive a fastening member.

5. The paneling system (100) of claim 1, further comprising an engagement lip (115) formed on a fastening element (102) of the two or more fastening elements (102).

6. The paneling system (100) of claim 1, wherein the two or more fastening elements (102) includes one or more stops (216).

7. The paneling system (100) of claim 1, wherein the panel (101) further comprises an aperture (650) formed in a lip (105) and adapted to receive at least a portion of the fastening element (102).

8. A fastening element (102) for a paneling system (100), comprising:

a coupling tab (112) formed at a first end of the fastening element (102) and adapted to engage with a lip (105) at the first edge (110) and couple to the first edge (110) of a panel (101);

an engagement lip (115) formed at a second end of the fastening element (102) and adapted to engage with a lip (106) at a second edge (111) of the panel (101) and couple to the second edge (111) of the panel (101) such that the fastening element (102) is coupled to a top surface (107) of the panel (101), extends from the first edge (110) to the second edge (111), and rests on the top surface (107) of the panel (101); and a rib (114) that is visible and extending along substantially an entire length of the fastening element (102) from the first edge (110) to the second edge (111) when two or more of the fastening elements (102) are coupled to the top surface (107) of the panel (101) such that the top surface (107) is substantially visible.

9. The fastening element (102) of claim 8, further comprising an aperture (113) formed in the coupling tab (112).

10. The fastening element (102) of claim 8, wherein the coupling tab (112) is provided at an angle (θ) with respect to a longitudinal axis X-X.

11. The fastening element (102) of claim 8, further comprising a stop (216).

12. A method for paneling a surface of a building, comprising steps of:

positioning one or more panels on the surface of the building, the one or more panels having a lip at a first edge and a lip at a second edge;

engaging the two or more fastening elements with the lip at the first edge and the lip at the second edge, wherein the two or more fastening elements comprise a rib that extends along substantially an entire length of the two or more fastening elements from the first edge to the second edge;

coupling two or more fastening elements to a top surface of a panel of the one or more panels, the two or more fastening elements extending from the first edge of the panel to the second edge of the panel and resting on the top surface of the panel; and coupling the two or more fastening elements to the surface of the building such that the rib and the top surface of the panel are substantially visible, thereby coupling the one or more panels to the building.

13. The method of claim 12, further comprising a step of extending the one or more panels substantially entirely across a length of the surface of the building.

14. The method of claim 12, further comprising a step of coupling a first lip formed on a first panel to a second lip formed on a second adjoining panel to form a substantially water tight seal.

15. The method of claim 12, further comprising a step of coupling a sealing member to at least one of the first lip or the second lip.

16. The method of claim 12, wherein the step of positioning the one or more panels on the surface of the building comprises positioning adjoining panels such that a horizontal seam is formed.

17. The method of claim 12, wherein the step of coupling one or more fastening elements to the panel comprises positioning the two or more fastening elements at substantially regular intervals along a length of the panel.

18. The method of claim 12, further comprising the step of coupling one or more stops to the two or more fastening elements.

* * * * *